US008235767B2

(12) United States Patent
Ferrell et al.

(10) Patent No.: US 8,235,767 B2
(45) Date of Patent: Aug. 7, 2012

(54) CRYOGENIC TREATMENT PROCESSES FOR DIAMOND ABRASIVE TOOLS

(75) Inventors: Robert C. Ferrell, Alpharetta, GA (US); Larry L. Benoit, Duluth, GA (US)

(73) Assignee: COLDfire Technology, LLC, Norcross, GA (US)

( * ) Notice: Subject to any disclaimer, the term of this patent is extended or adjusted under 35 U.S.C. 154(b) by 768 days.

(21) Appl. No.: 12/343,130

(22) Filed: Dec. 23, 2008

(65) Prior Publication Data

US 2009/0170414 A1 Jul. 2, 2009

Related U.S. Application Data

(60) Provisional application No. 61/017,105, filed on Dec. 27, 2007.

(51) Int. Cl.
*B24B 49/00* (2012.01)

(52) U.S. Cl. ..... 451/7; 51/306; 62/65

(58) Field of Classification Search ..... 451/7; 62/62, 62/65; 51/306, 309

See application file for complete search history.

(56) References Cited

U.S. PATENT DOCUMENTS

| | | | | |
|---|---|---|---|---|
| 3,940,276 | A | 2/1976 | Wilson | |
| 3,973,977 | A | 8/1976 | Wilson | |
| 4,247,303 | A * | 1/1981 | Inoue | 51/295 |
| 4,614,544 | A * | 9/1986 | Lall | 75/246 |
| 4,739,622 | A * | 4/1988 | Smith | 62/78 |
| 4,925,457 | A | 5/1990 | deKok et al. | |
| 5,174,122 | A * | 12/1992 | Levine | 62/50.2 |
| 5,259,200 | A * | 11/1993 | Kamody | 62/64 |
| 5,447,035 | A | 9/1995 | Workman et al. | |
| 6,141,974 | A * | 11/2000 | Waldmann et al. | 62/62 |
| 6,164,079 | A | 12/2000 | Waldmann et al. | |
| 6,314,743 | B1 * | 11/2001 | Hutchison | 62/62 |
| 6,332,325 | B1 * | 12/2001 | Monfort | 62/62 |
| 6,506,270 | B2 * | 1/2003 | Takashina et al. | 148/578 |
| 6,537,396 | B1 | 3/2003 | Ijames | |
| 6,745,479 | B2 | 6/2004 | Dirks et al. | |
| 6,769,964 | B2 | 8/2004 | Tunstall | |
| 7,163,595 | B2 | 1/2007 | Watson | |
| 7,234,550 | B2 | 6/2007 | Azar et al. | |
| 7,297,418 | B2 | 11/2007 | Watson | |
| 2004/0261917 | A1 * | 12/2004 | Watson | 148/577 |
| 2004/0265647 | A1 * | 12/2004 | Watson | 428/698 |
| 2005/0047989 | A1 * | 3/2005 | Watson | 423/446 |
| 2005/0077089 | A1 * | 4/2005 | Watson | 175/327 |

OTHER PUBLICATIONS

International Search Report and Written Opinion for PCT/US2008/088173 dated Apr. 17, 2009.

* cited by examiner

*Primary Examiner* — Maurina Rachuba
(74) *Attorney, Agent, or Firm* — Michael Best & Friedrich LLP

(57) ABSTRACT

Embodiments of the invention can provide cryogenic treatment processes for diamond abrasive tools. One process in accordance with an embodiment of this invention can include introducing an abrasive tool into a cycling chamber, wherein the tool has a temperature of about ambient temperature; and introducing at least one cryogenic material into the chamber, wherein the internal temperature of the chamber or tool can be controlled by adjusting the flow rate of the at least one cryogenic material. The process can result in a strengthened and toughened abrasive tool. The process can be repeated multiple times.

20 Claims, 12 Drawing Sheets

Cryogenic Treatment

Cryogenic Treatment

CRYOGENIC TREATMENT PROCESSES FOR DIAMOND ABRASIVE TOOLS

RELATED APPLICATION

This application claims priority to U.S. Ser. No. 61/017,105, entitled "Cryogenic Treatment Process for Diamond Abrasive Tools", filed Dec. 27, 2007, the contents of which are hereby incorporated by reference.

FIELD OF THE INVENTION

This invention relates to cryogenic thermal cycling treatment of hard-particle based abrasive tools and the like. In particular, this invention relates to cryogenic treatment processes for diamond abrasive tools.

BACKGROUND OF THE INVENTION

Abrasive tools that utilize relatively hard particles are known in the art. These include tools with embedded single crystal diamonds and polycrystalline diamonds (PCD). One technique for manufacturing abrasive tools of this type involves placing the relatively hard particles in a matrix material such as a metal powder or resin, then compressing and sintering the material onto the surface of the tool body. When polycrystalline diamonds are utilized, the final compressed-and-sintered product is often referred to as a polycrystalline diamond compact (PDC) material. U.S. Pat. No. 7,234,550 to Azar relates to a process for manufacturing drill bit inserts. U.S. Pat. No. 4,925,457 to deKok relates to a variant of this manufacturing process wherein a carrier such as a wire mesh helps secure the relatively hard particles to the tool body and also serves to locate the relatively hard particles in a desired pattern. The '550 patent to Azar further relates that relatively high temperatures associated with the sintering process are known to decrease the service life of both natural and synthetic diamonds in such abrasive tools.

A second technique for manufacturing abrasive tools involves electroplating the relatively hard particles to a tool body metal surface. In this technique a relatively thin layer of relatively hard particles is placed onto the metal surface, and successive layers of metal are electroplated onto the substrate and particles until the relatively hard particles are secured. Abrasive tools manufactured by the electroplating technique tend to be delicate in that the relatively hard particles are secured only by relatively thin layers of metal. U.S. Pat. No. 6,745,479 to Dirks relates to a process for manufacturing such abrasive tools wherein diamond particles are secured to a surface via layers of electroplated chromium. Variants of these manufacturing techniques are also known in the art.

Abrasive tools that utilize relatively hard particles are commonly employed as drills, disks, wheels and the like for drilling, deburring, grinding, dressing, polishing, lapping, honing, and roughening. Such abrasive tools typically reach the end of their service life when one of the following occurs: The majority of the relatively hard particles are dislodged and removed from the cutting surface of the tool thereby decreasing the cutting efficiency; or the relatively hard particles on the cutting surface have fractured and made dull thereby decreasing the cutting efficiency. There is a need in the art to provide relatively hard particle-based abrasive tools that are resistant to these degradations and as a result have improved service life. In particular, there is a need in the art to provide improved service life for abrasive tools that utilize single crystal and polycrystalline diamond particles.

Cryogenic thermal cycling is known in the art of materials treatment, and is often used to strengthen and provide increased wear properties of certain articles of manufacture. U.S. Pat. No. 6,332,325 to Monfort relates to an apparatus and method for strengthening certain articles of manufacture through cryogenic thermal cycling. U.S. Pat. No. 6,314,743 to Hutchison relates to a cryogenic tempering process for certain printed circuit-board drill bits. U.S. Pat. No. 6,164,079 to Waldmann relates to cryogenic treatment of certain silicon nitride tool and machine parts. U.S. Pat. No. 5,447,035 to Workman relates to cryogenic treatment of certain types of brake pads. U.S. Pat. No. 7,163,595 to Watson relates to a cryogenic thermal process for treating certain metals to improve structural characteristics. U.S. Pat. No. 7,297,418 also to Watson relates to cryogenic thermal cycling treatment of certain carbide materials commonly used for cutting tools, drills and the like. United States Patent Application 20050047989 to Watson relates to cryogenic treatment of certain diamond materials.

The '989 patent application by Watson relates to a process by which certain diamond and diamond compact materials can purportedly be toughened. Thermal treatment of many materials can produce a material with increased fracture toughness, but at the expense of strength, hardness, and wear properties—the latter of which may be relatively important for abrasive tools. The subject of strength and fracture toughness is thoroughly discussed in the text "Strength and Toughness of Materials" by Toshiro Kobayashi.

Accordingly, there is a need for certain treatments for relatively hard-particle based abrasive tools that provide increased cutting performance through increases in strength, hardness, fracture toughness and wear resistance. In particular, there is a need for cryogenic thermal cycling treatments for diamond-based abrasive tools that provide increased cutting performance and service life through increases in strength, hardness, fracture toughness and wear resistance.

SUMMARY OF THE INVENTION

Embodiments of the invention can address some or all of the above needs. Certain embodiments of the invention can provide systems and methods for treating diamond abrasive tools. Certain other embodiments of the invention can provide cryogenic treatment processes for diamond abrasive tools. Other embodiments of the invention can provide strengthened and hardened abrasive tools.

One process in accordance with an embodiment of this invention is a cryogenic thermal cycling process for abrasive tools that utilize diamond materials. The process can include introducing an abrasive tool into a cycling chamber, wherein the tool has a temperature of about ambient temperature; and introducing at least one cryogenic material into the cycling chamber, wherein the internal temperature of the cycling chamber or abrasive tool can be controlled by adjusting the flow rate of the at least one cryogenic material. The process can further include decreasing the temperature of the cycling chamber or abrasive tool to a range from about −80 degrees Fahrenheit (F). to about −100 degrees F. at a rate of about −0.5 degrees F. per minute to about −10 degrees F. per minute; and further decreasing the temperature of the cycling chamber or abrasive tool to a range from about −275 degrees F. to about −325 degrees F. at a rate of about −0.05 degrees F. per minute to about −0.25 degrees F. per minute. The process can also include increasing the temperature of the cycling chamber or abrasive tool to a range from about −80 degrees F. to about −100 degrees F. at a rate of about 0.05 degrees F. per minute to about 0.25 degrees F. per minute; and further increasing the temperature of the cycling chamber or abrasive tool to about ambient temperature at a rate of about 0.5 degrees F. per minute to about 10 degrees F. per minute, wherein the process results in a strengthened and toughened abrasive tool. This process can be repeated multiple times if desired.

In another embodiment, an abrasive tool can be provided. The abrasive tool can include at least one diamond-based material, wherein the abrasive tool is formed by a process that can include introducing the abrasive tool into a cycling chamber, wherein the tool has a temperature of about ambient temperature, and introducing at least one cryogenic material into the cycling chamber, wherein the internal temperature of the cycling chamber or abrasive tool can be controlled by adjusting the flow rate of the at least one cryogenic material. The process can also include decreasing the temperature of the cycling chamber or abrasive tool from ambient temperature to a range from about −80 degrees Fahrenheit (F). to about −100 degrees F. at a rate of about −0.5 degrees F. per minute to about −10 degrees F. per minute, and further decreasing the temperature of the cycling chamber or abrasive tool to a range from about −275 degrees F. to about −325 degrees F. at a rate of about −0.05 degrees F. per minute to about −0.25 degrees F. per minute. The process can also include increasing the temperature of the cycling chamber or abrasive tool to a range from about −80 degrees F. to about −100 degrees F. at a rate of about 0.05 degrees F. per minute to about 0.25 degrees F. per minute, and further increasing the temperature of the cycling chamber or abrasive tool to about ambient temperature at a rate of about 0.5 degrees F. per minute to about 10 degrees F. per minute.

In another embodiment, a process to treat an abrasive tool using at least one cryogenic material in a cycling chamber can be provided. The process can include decreasing the temperature of the cycling chamber or abrasive tool from ambient temperature to a range from about −80 degrees Fahrenheit (F). to about −100 degrees F. at a rate of about −0.5 degrees F. per minute to about −10 degrees F. per minute. The process can further include further decreasing the temperature of the cycling chamber or abrasive tool to a range from about −275 degrees F. to about −325 degrees F. at a rate of about −0.05 degrees F. per minute to about −0.25 degrees F. per minute. In addition, the process can include increasing the temperature of the cycling chamber or abrasive tool to a range from about −80 degrees F. to about −100 degrees F. at a rate of about 0.05 degrees F. per minute to about 0.25 degrees F. per minute. Furthermore, the process can include increasing the temperature of the cycling chamber or abrasive tool to about ambient temperature at a rate of about 0.5 degrees F. per minute to about 10 degrees F. per minute, and resulting in a strengthened and toughened abrasive tool.

Diamond-based abrasive tools treated by the cryogenic thermal cycling process in accordance with a certain embodiment of the invention can exhibit improved performance and service life during comparison testing against untreated tools and tools treated using conventional thermal cycling processes.

Accordingly, it is an aspect of an embodiment of the invention to provide a process for treating abrasive tools that utilize diamond materials.

Another aspect of an embodiment of the invention can provide diamond-based abrasive tools that have improved service life and cutting performance.

Another aspect of an embodiment of the invention can provide diamond-based abrasive tools wherein the diamond particles are better-adhered or better-secured to the tool body.

Another aspect of an embodiment of the invention can provide diamond-based abrasive tools wherein the strength and toughness of the diamond particles are improved.

Another aspect of an embodiment of the invention can provide diamond-based abrasive tools wherein sintering-induced strength and fracture toughness degradations of the diamond particles are undone.

Other aspects, features, and embodiments of the invention will become apparent upon a reading of the following description.

DESCRIPTION OF THE EMBODIMENTS OF THE INVENTION

The invention now will be described more fully hereinafter with reference to the accompanying drawings, in which embodiments of the invention are shown. This invention may, however, be embodied in many different forms and should not be construed as limited to the embodiments set forth herein; rather, these embodiments are provided so that this disclosure will be thorough and complete, and will convey the scope of the invention. Like numbers refer to like elements throughout.

As used herein, the term "abrasive tool" and its pluralized form should be construed to mean a diamond-tipped drill bit, a diamond core drill, a diamond-based saw blade, diamond-based scissors, a diamond-based grinding wheel, a diamond-based cutoff wheel, a diamond-based abrasive blade, a segmented rim diamond abrasive blade, a continuous rim diamond abrasive blade, diamond-based abrasive tooling, and any other relatively sharp tool utilizing at least one diamond-based material.

As used herein, the terms "cycling chamber", "chamber", and "cryogenic treatment system cycling chamber", and their respective pluralized forms should be construed to mean a container associated with a cryogenic-type system, wherein the container is operable to receive an abrasive tool.

As used herein, the term "diamond abrasive tool" and its pluralized form should be construed to mean an abrasive tool that includes at least one diamond-based material.

As used herein, the term "ambient temperature" should be construed to mean room temperature.

As used herein, the term "cryogenic material" should be construed to mean oxygen, helium, argon, hydrogen, nitrogen, and any combination thereof.

As used herein, the term "computer-readable medium" should be construed to mean any form of memory or a propagated signal transmission medium. Propagated signals representing data and computer-executable instructions can be transferred between processor-based devices and systems.

Figure 1:
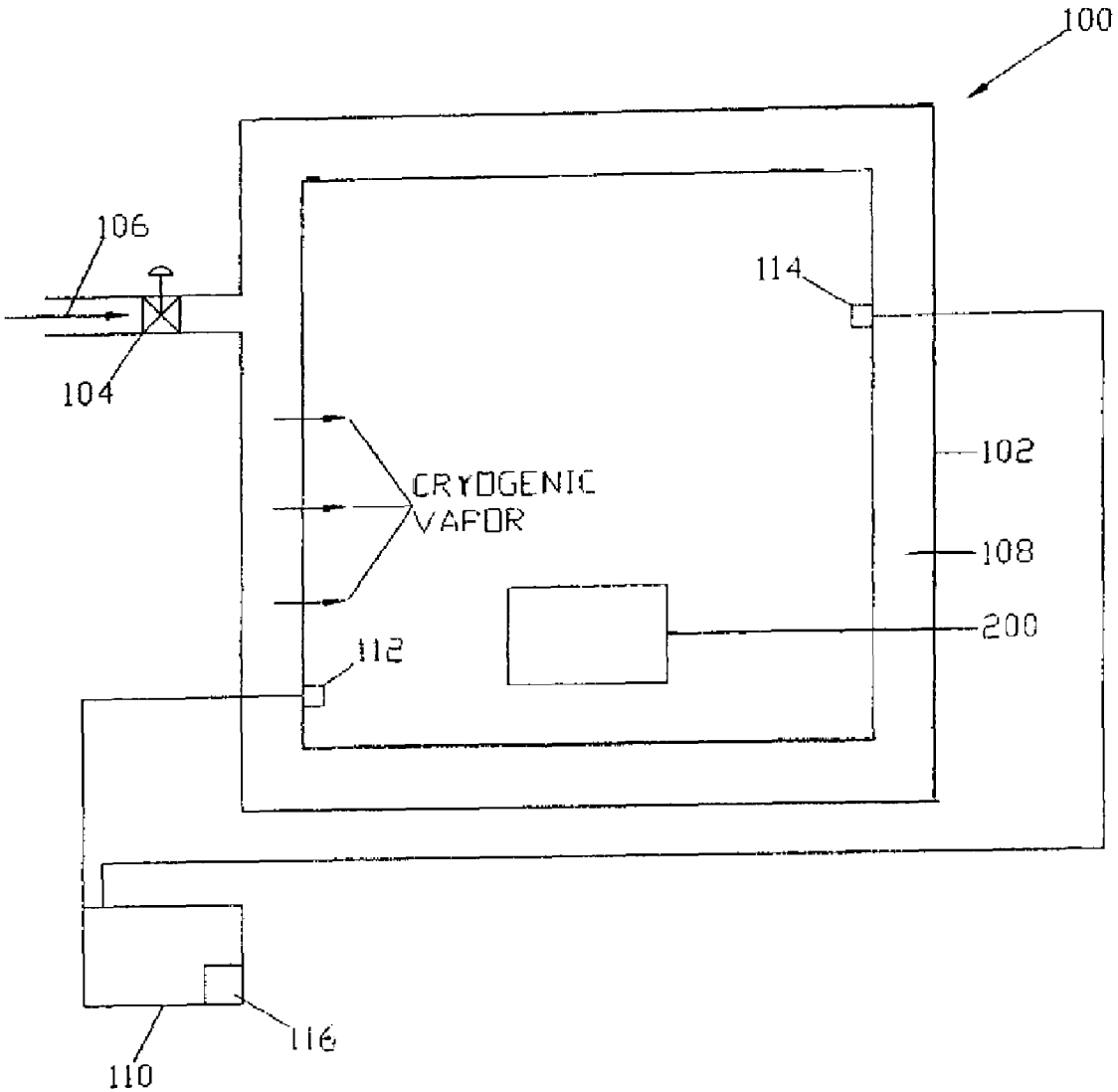
FIG. 1 is an example system to treat an abrasive tool using a cycling chamber according to an embodiment of the invention.

FIG. 1 is an example system to treat an abrasive tool using a cycling chamber according to an embodiment of the invention. Referring to FIG. 1, a system 100 can include a cycling chamber 102, wherein an abrasive tool, such as 200 in FIG. 2, can be introduced. The system can include at least one valve 104 through which at least one cryogenic material 106 can be introduced into the cycling chamber 102, wherein the temperature of the chamber 102 can be increased or decreased depending on whether the valve 104 is open or closed. In at least one embodiment, other cryogenic materials may be introduced into the chamber 102 to increase or decrease the temperature of the chamber 102. In other embodiments, the chamber 602 can be a multi-walled insulated chamber, a vacuum chamber, or a vacuum-insulated chamber.

As shown in FIG. 1, the system 100 can also include a heat exchanger 108 positioned within the chamber 102 to generate at least one cryogenic vapor within the chamber 102. When the cryogenic material 106 is released into the heat exchanger 108, heat can be absorbed from the chamber 102 and into the heat exchanger 108, wherein a cryogenic vapor can be generated to fill the chamber 102. Examples of suitable cryogenic vapors can include, but are not limited to, oxygen, helium, argon, hydrogen, nitrogen, and any combination thereof. The system 100 can also include at least one processor 110 operable to control introduction of at least one cryogenic material 106 via the at least one valve 104. An example of a suitable valve is a solenoid-operated valve. In the embodiment shown, one or more thermocouples 112, 114 located within the chamber 102 can provide real-time temperature measurement of the chamber 102, and feedback to the at least one processor 110. Utilizing the feedback, the at least one processor 110 can follow a pre-programmed profile including temperature targets and rates. Example pre-programmed profiles can include, but are not limited to, an initial descent portion, an intermediate descent portion, a treatment descent portion, a treatment hold or soak portion, a treatment ascent portion, an intermediate ascent portion, a final ascent portion, a repeated portion, and any combination thereof. Any number of pre-programmed profiles can be stored in a memory 116 associated with or otherwise accessible by the at least one processor 110. One may appreciate that any tool placed in the chamber 102 will track the temperature of the chamber 102, and that the temperature of the tool will slightly lag the temperature of the chamber 102. In any instance, certain embodiments of the invention herein can utilize either the temperature of the tool or of the chamber 102 to implement the various processes described herein.

Embodiments of a system, such as 100, can facilitate certain cryogenic treatment processes for diamond abrasive tools. Furthermore, certain embodiments of a system, such as 100, can facilitate a process to treat an abrasive tool using a cycling chamber. An example abrasive tool provided by a system, such as 100, is shown as 200 in FIG. 2. Example operations of a system, such as 100 of FIG. 1, and its various components as well as associated methods and processes are described by reference to FIGS. 3-12.

Figure 2:
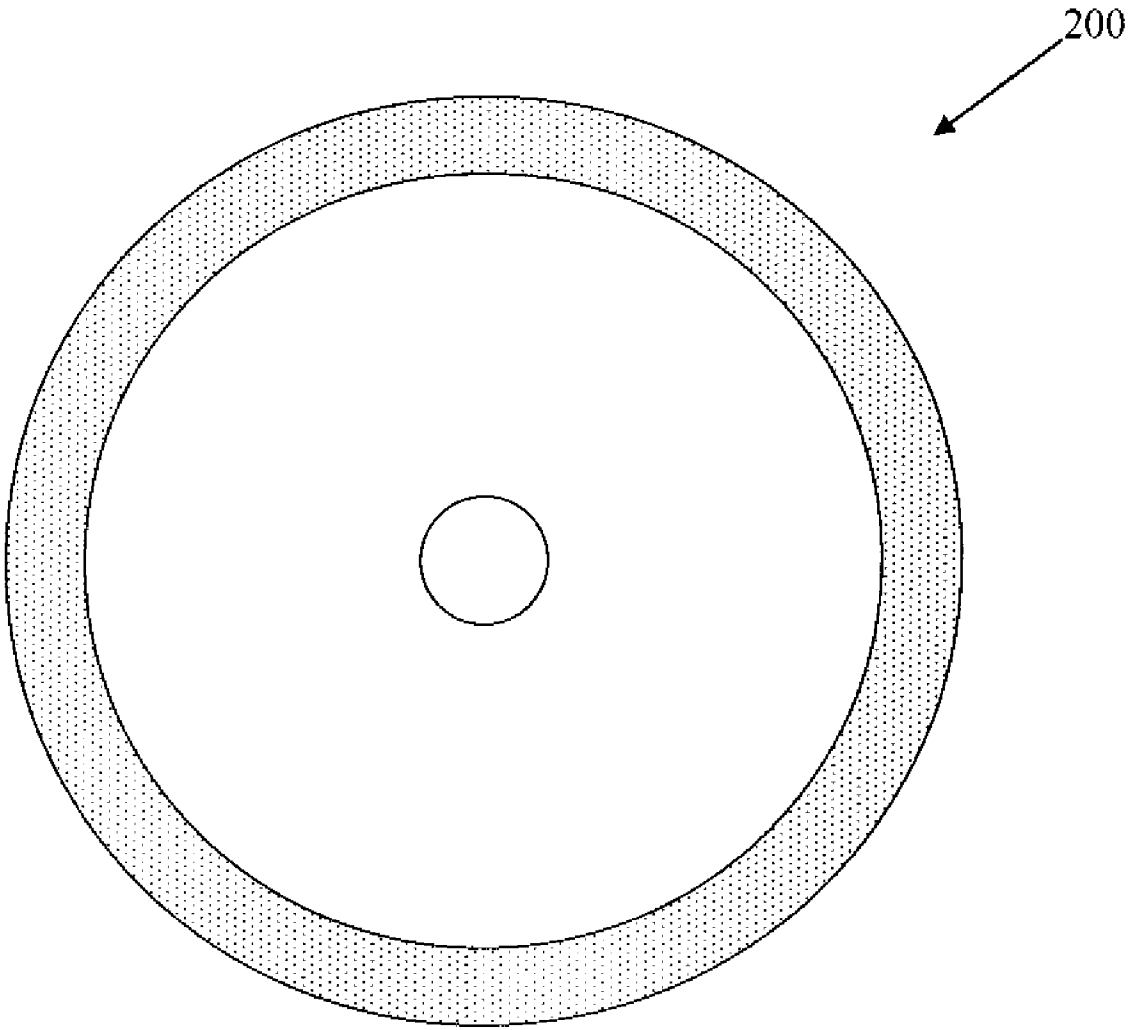
FIG. 2 is an example abrasive tool according to an embodiment of the invention.

FIG. 2 is an example abrasive tool according to an embodiment of the invention. As shown in FIG. 2, an abrasive tool 200 can be, for example, a continuous rim diamond blade. Generally, an abrasive tool can include at least one diamond-based material. In other embodiments, an abrasive tool can include, but is not limited to, diamond-tipped drill bits, diamond core drills, diamond-based saw blades, diamond-based scissors, diamond-based grinding wheels, diamond-based cutoff wheels, diamond-based abrasive blades, segmented rim diamond abrasive blades, diamond-based abrasive tooling, and any other relatively sharp tool utilizing at least one diamond-based material.

Figure 3:
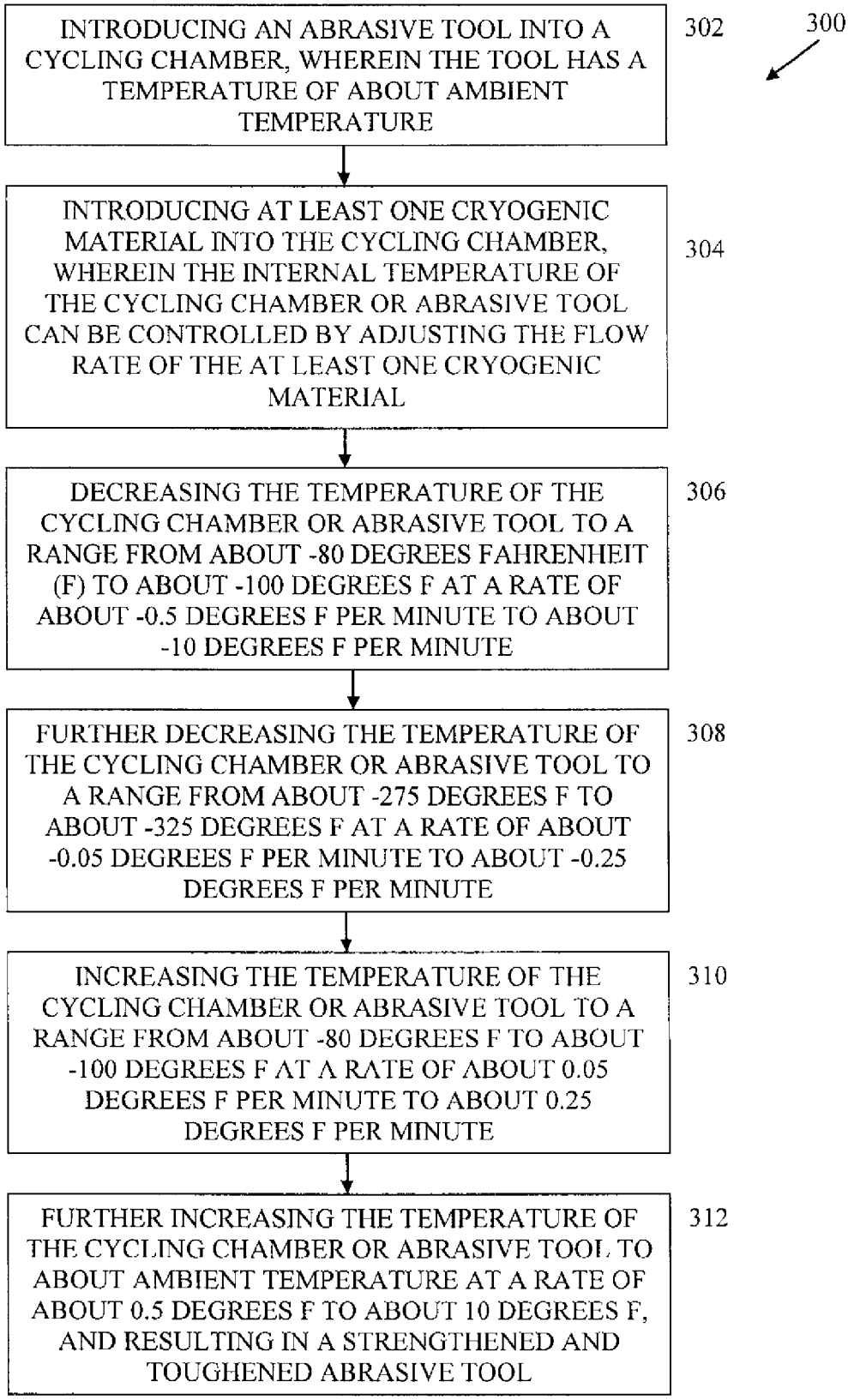
FIG. 3 is an example process to treat an abrasive tool using a cycling chamber according to an embodiment of the invention.

FIG. 3 is an example process to treat an abrasive tool using a cycling chamber according to an embodiment of the invention. In the embodiment shown in FIG. 3, the process 300 can begin at block 302.

At block 302, an abrasive tool can be introduced into a cycling chamber, wherein the tool has a temperature of about ambient temperature.

In one aspect of an embodiment, introducing an abrasive tool into a cycling chamber can include introducing an abrasive tool comprising at least one diamond-based material.

Block 302 is followed by block 304, in which at least one cryogenic material can be introduced into the cycling chamber, wherein the internal temperature of the cycling chamber or abrasive tool can be controlled by adjusting the flow rate of the at least one cryogenic material.

Block 304 is followed by block 306, in which the temperature of the cycling chamber or abrasive tool is decreased to a range from about −80 degrees Fahrenheit (F). to about −100 degrees F. at a rate of about −0.5 degrees F. per minute to about −10 degrees F. per minute.

Block 306 is followed by block 308, in which the temperature of the cycling chamber or abrasive tool is further decreased to a range from about −275 degrees F. to about −325 degrees F. at a rate of about −0.05 degrees F. per minute to about −0.25 degrees F. per minute.

In one aspect of an embodiment, further decreasing the temperature of the cycling chamber or abrasive tool to a range from about −275 degrees F. to about −325 degrees F. can include decreasing the temperature at a rate of about −0.10 degrees F. per minute to about −0.20 degrees F. per minute.

Block 308 is followed by block 310, in which the temperature of the cycling chamber or abrasive tool is increased to a range from about −80 degrees F. to about −100 degrees F. at a rate of about 0.05 degrees F. per minute to about 0.25 degrees F. per minute.

In one aspect of an embodiment, increasing the temperature of the cycling chamber or abrasive tool to about −80 degrees F. to about −100 degrees F. can include increasing the temperature at a rate of about 0.10 degrees per minute to about 0.20 degrees F. per minute.

Block 310 is followed by block 312, in which the temperature of the cycling chamber or abrasive tool is further increased to about ambient temperature at a rate of about 0.5 degrees F. per minute to about 10 degrees F. per minute, and resulting in a strengthened and toughened abrasive tool.

In one aspect of an embodiment, the process can include maintaining the temperature of the cycling chamber or abrasive tool in range from about −275 degrees F. to about −325 degrees F. for about 0.1 hours to about 24 hours.

In one aspect of an embodiment, the process can include maintaining the temperature of the cycling chamber or abrasive tool in a range from about −275 degrees F. to about −325 degrees F. for about 17 hours.

In one aspect of an embodiment, the process can include decreasing the temperature of the cycling chamber or abrasive tool from ambient temperature to about −10 degrees Fahrenheit (F). at a rate of about −1.0 degrees F. per minute; further decreasing the temperature of the cycling chamber or abrasive tool to about −190 degrees F. at a rate of about −0.2 degrees F. per minute; maintaining the temperature of the cycling chamber or abrasive tool at about −280 degrees F. for about 17 hours; increasing the temperature of the cycling chamber or abrasive tool to about −190 degrees F. at a rate of about 0.1 degrees F. per minute; and further increasing the temperature of the cycling chamber or abrasive tool to about −10 degrees F. at a rate of about 0.5 degrees F. per minute.

After block 310, the method 300 ends.

The example elements of FIG. 3 are shown by way of example, and other process embodiments can have fewer or greater numbers of elements, and such elements can be arranged in alternative configurations in accordance with other embodiments of the invention. It will be understood that each block of the block diagrams and flowchart illustrations, and combinations of blocks in the block diagrams and flowchart illustrations, respectively, can be implemented by computer program instructions. These computer program instructions may be loaded onto a general purpose computer, special purpose computer such as a switch, a processor or special purpose processor, or other programmable data processing apparatus to produce a machine, such that the instructions which execute on the computer or other programmable data processing apparatus create means for implementing the functions specified in the flowchart block or blocks.

These computer program instructions may also be stored in a computer-readable memory that can direct a computer or other programmable data processing apparatus to function in a particular manner, such that the instructions stored in the computer-readable memory produce an article of manufacture including instruction means that implement the function specified in the flowchart block or blocks. The computer program instructions may also be loaded onto a computer or other programmable data processing apparatus to cause a series of operational elements or steps to be performed on the computer or other programmable apparatus to produce a computer implemented process such that the instructions that execute on the computer or other programmable apparatus provide elements for implementing the functions specified in the flowchart block or blocks.

Accordingly, blocks of the block diagrams and flowchart illustrations support combinations of means for performing the specified functions, combinations of elements or steps for performing the specified functions and program instruction means for performing the specified functions. It will also be understood that each block of the block diagrams and flowchart illustrations, and combinations of blocks in the block diagrams and flowchart illustrations, can be implemented by special purpose hardware-based computer systems that perform the specified functions, elements, or combinations of special purpose hardware and computer instructions.

Referring to FIGS. 4-12, these diagrams illustrate various embodiments of cryogenic treatment processes for a diamond abrasive tool as well as comparisons to conventional processes. Some or all of the illustrated processes in FIGS. 4-12 according to various embodiments of the invention can be implemented with a system shown as 100 in FIG. 1. Some or all of the illustrated processes in FIGS. 4-12 according to various embodiments of the invention can provide an abrasive tool shown as 200 in FIG. 2.

Figure 4:
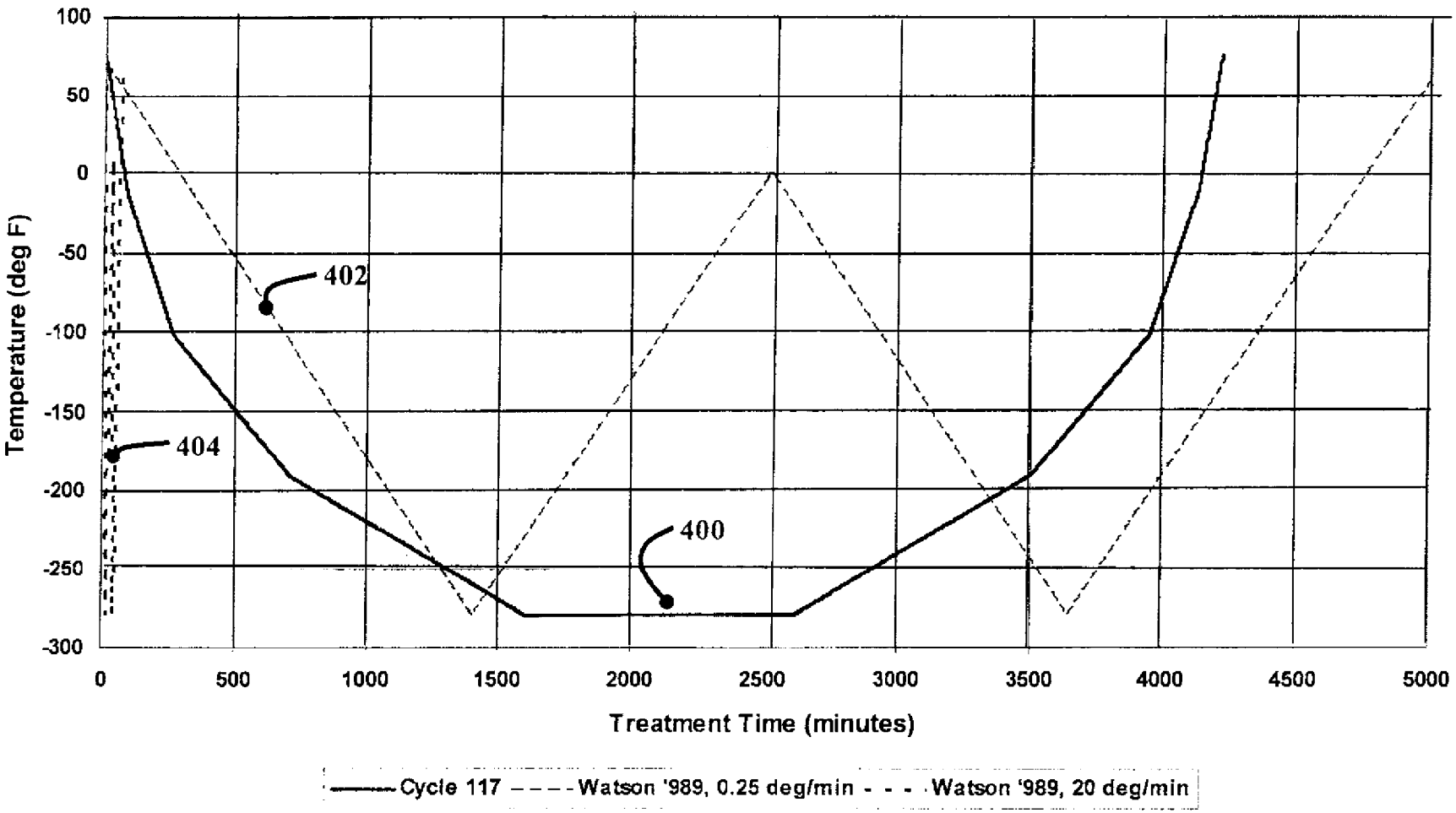
FIG. 4 is a first comparison of one embodiment of the invention, the Cycle 117, with particular cycles from the Watson '989 application.

FIG. 4 is a first comparison of the Cycle 117 with cryogenic cycles from the Watson '989 application. In contrast to the Watson '989 application process, the Cycle 117 can include a treatment hold or soak portion at the end of an initial temperature descent. The Cycle 117 400 is one embodiment of the invention. The Cycle 117 400 can include placing or introducing an abrasive tool, such as a diamond abrasive tool, within a cycling chamber of a cryogenic treatment system, such as 100 in FIG. 1, and implementing the following temperature cycle: Lowering the temperature within the cycling chamber or abrasive tool to about −10 degrees F. at a rate of about −1 degrees F. per minute, further lowering the temperature to about −100 degrees F. at a rate of about −0.5 degrees F. per minute, further lowering the temperature to about −190 degrees F. at a rate of about −0.2 degrees F. per minute, further lowering the temperature to about −280 degrees F. at a rate of about −0.1 degrees F. per minute, holding temperature at about −280 degrees F. for about 17 hours, raising the temperature to about −190 degrees F. at a rate of about +0.1 degrees F. per minute, further raising the temperature to about −100 degrees F. at a rate of about +0.2 degrees F. per minute, further raising the temperature to about −10 degrees F. at a rate of about +0.5 degrees F. per minute, then raising the temperature to ambient temperature at a rate of about +1 degrees F. per minute.

As used herein, references to increasing or decreasing certain temperatures within the cycling chamber should be construed to mean increasing or decreasing temperatures of any articles introduced into the cycling chamber.

According to embodiments of the invention, certain cryogenic treatments with extremely low rates of increasing or decreasing temperature change can have a beneficial effect on the performance of diamond-based abrasive tools. Further, certain ranges of temperatures for these relatively low rates of temperature change can be from about −80 degrees F. to about −300 degrees F. Referring again to FIG. 4: Cycle 402 from Watson '989 has temperature rates that range from about +/−0.25 degrees F. per minute (number 402 in FIG. 4) to about +/−20 degrees F. per minute (number 404 in FIG. 4). These rates of temperature change are conventional and are not nearly as slow as the about 0.1 degrees F. to about 0.2 degrees F. per minute rates within an embodiment of the invention shown as 400.

Figure 5:
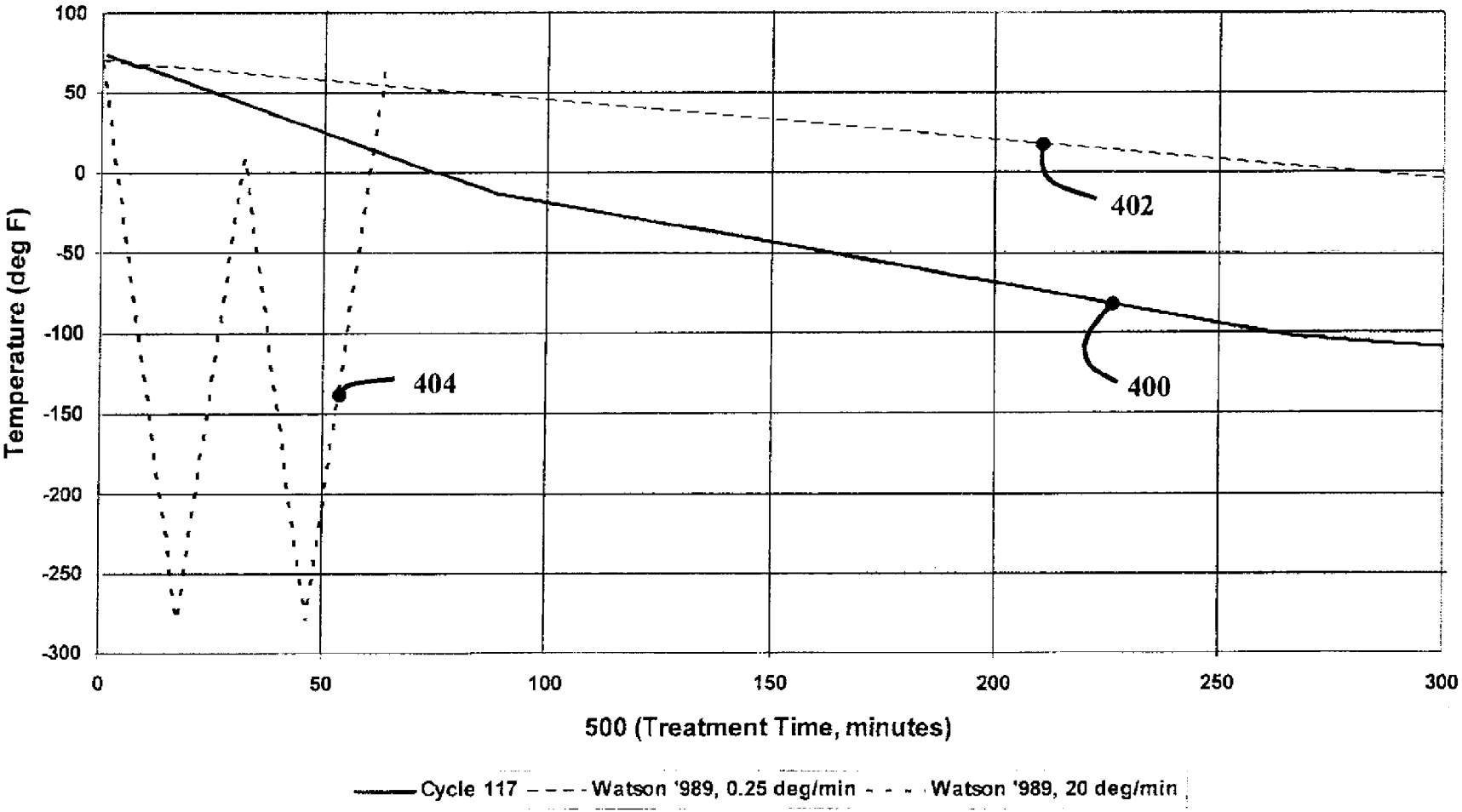
FIG. 5 is a second comparison of another embodiment of the invention, the Cycle 117, with particular cycles from the Watson '989 application.

FIG. 5 is a second comparison of the Cycle 117 400 with cycles 402 and 404 from the Watson '989 application. In FIG. 5, the timescale 500 is expanded to show the details of cycle 404 that has about +/−20 degrees F. per minute temperature ramps.

Figure 6:
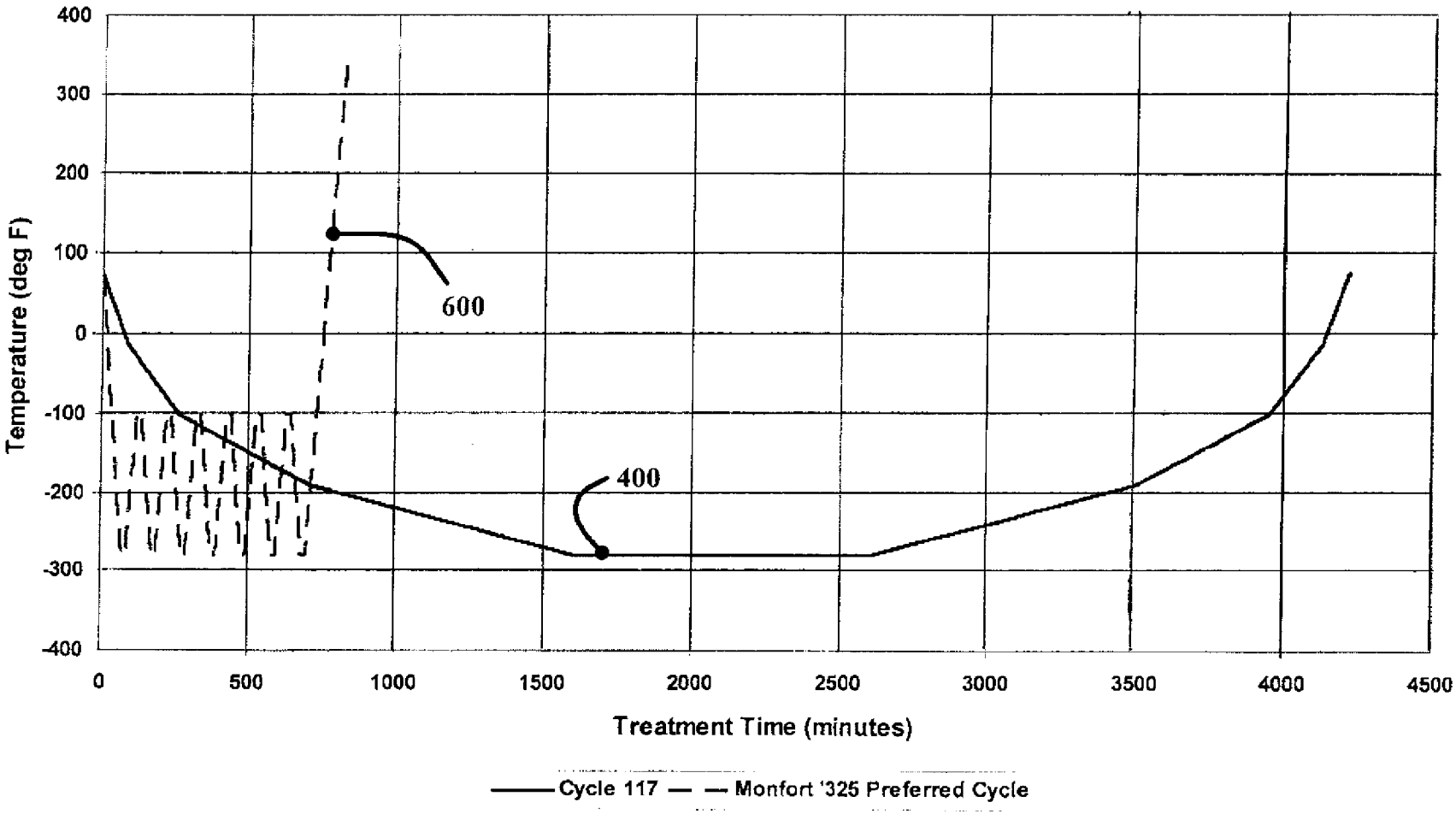
FIG. 6 is a comparison of another embodiment of the invention, the Cycle 117 with one particular cycle from the Monfort '325 patent.

FIG. 6 is a comparison of the Cycle 117 400 with a cycle 600 from the Monfort '325 patent. The cycle 600 of the Monfort '325 patent has temperature ramps of about −5 degrees F. and about +5 degrees F. per minute. The Monfort '325 patent relates to temperature ramps as slow as 0.1 degrees F. per minute during cryogenic processing. However, the Monfort '325 does not appear to relate to relatively slower temperature ramps compared to more rapid temperature ramps for particular materials or articles of treatment. Furthermore, the Monfort '325 patent does not appear to relate to treatment of diamond materials, diamond-based materials, diamond-based abrasive tools, or diamond abrasive tools.

Figure 7:
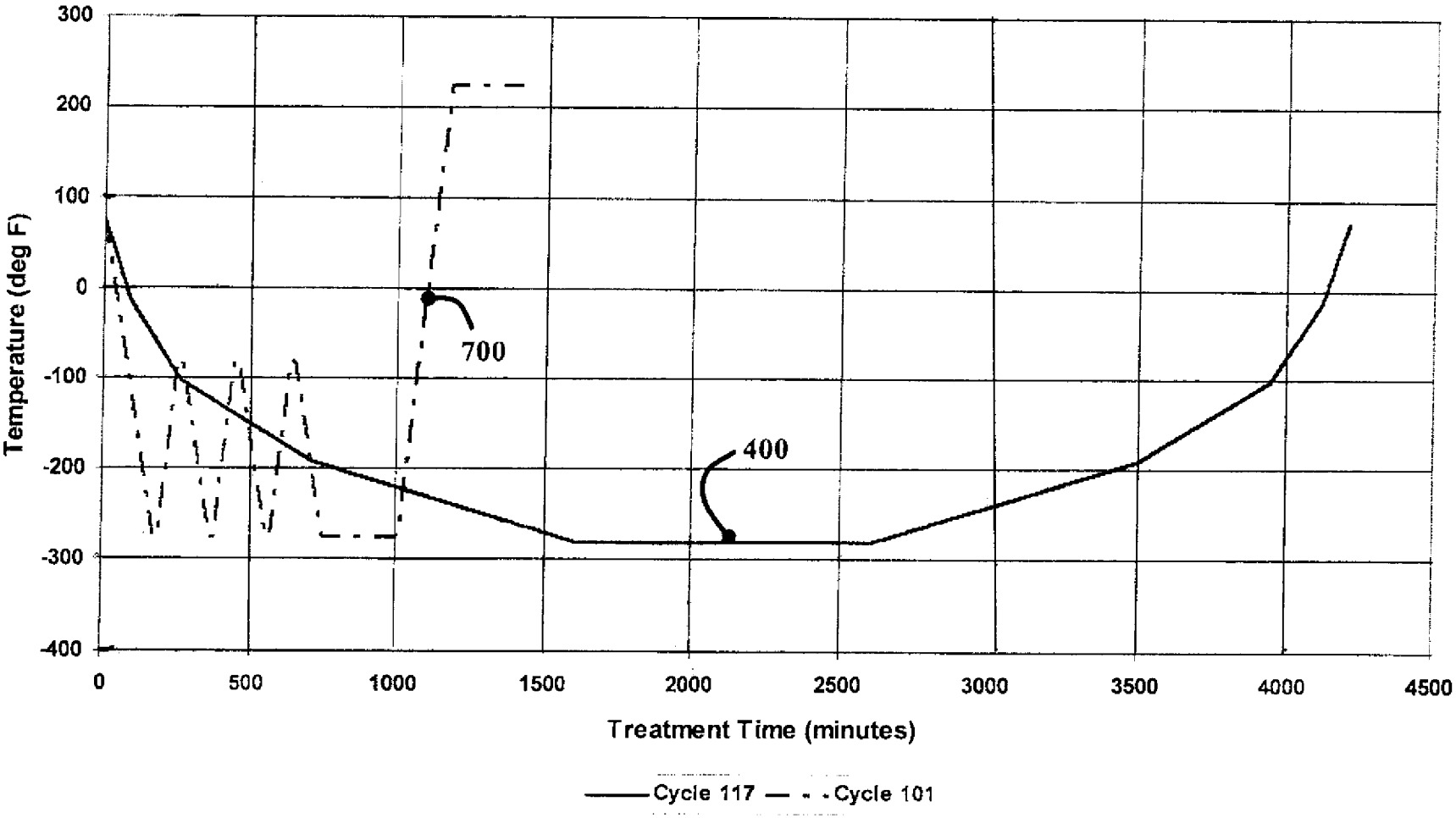
FIG. 7 is a comparison of an embodiment of the invention, the Cycle 117, with another embodiment of the invention, the Cycle 101.

FIG. 7 is a comparison of the Cycle 117 (element 400 in FIG. 7) with the Cycle 101 (element 700 in FIG. 7). Cycle 101 700 can be used to cryogenically treat, for example, aluminum oxide or zirconia alumina materials including grinding wheels and cutoff wheels. Cycle 101 700 can include placing or introducing an article within a cycling chamber of a cryogenic treatment system such as 100 in FIG. 1, then implementing the following temperature cycle: Lowering the temperature within the cycling chamber or abrasive tool to about −275 degrees F. at a rate of about −2 degrees F. per minute, raising the temperature to about −80 degrees F. at a rate of about +3 degrees F. per minute, lowering the temperature to about −275 degrees F. at a rate of about −2 degrees F. per minute, raising the temperature to about −80 degrees F. at a rate of about +3 degrees F. per minute, lowering the temperature to about −275 degrees F. at a rate of about −2 degrees F. per minute, raising the temperature to about −80 degrees F. at a rate of about +3 degrees F. per minute, lowering the temperature to about −275 degrees F. at a rate of about −2 degrees F. per minute, holding temperature at about −275 degrees F. for about 4 hours, then raising the temperature to +275 degrees F. at a rate of about +3 degrees F. per minute. In an example below, comparison of both the Cycle 101 700 and Cycle 117 400 can illustrate a beneficial effect on the strength and performance of diamond-based cutting tools, with the Cycle 117 400 providing relatively better results.

Figure 8:
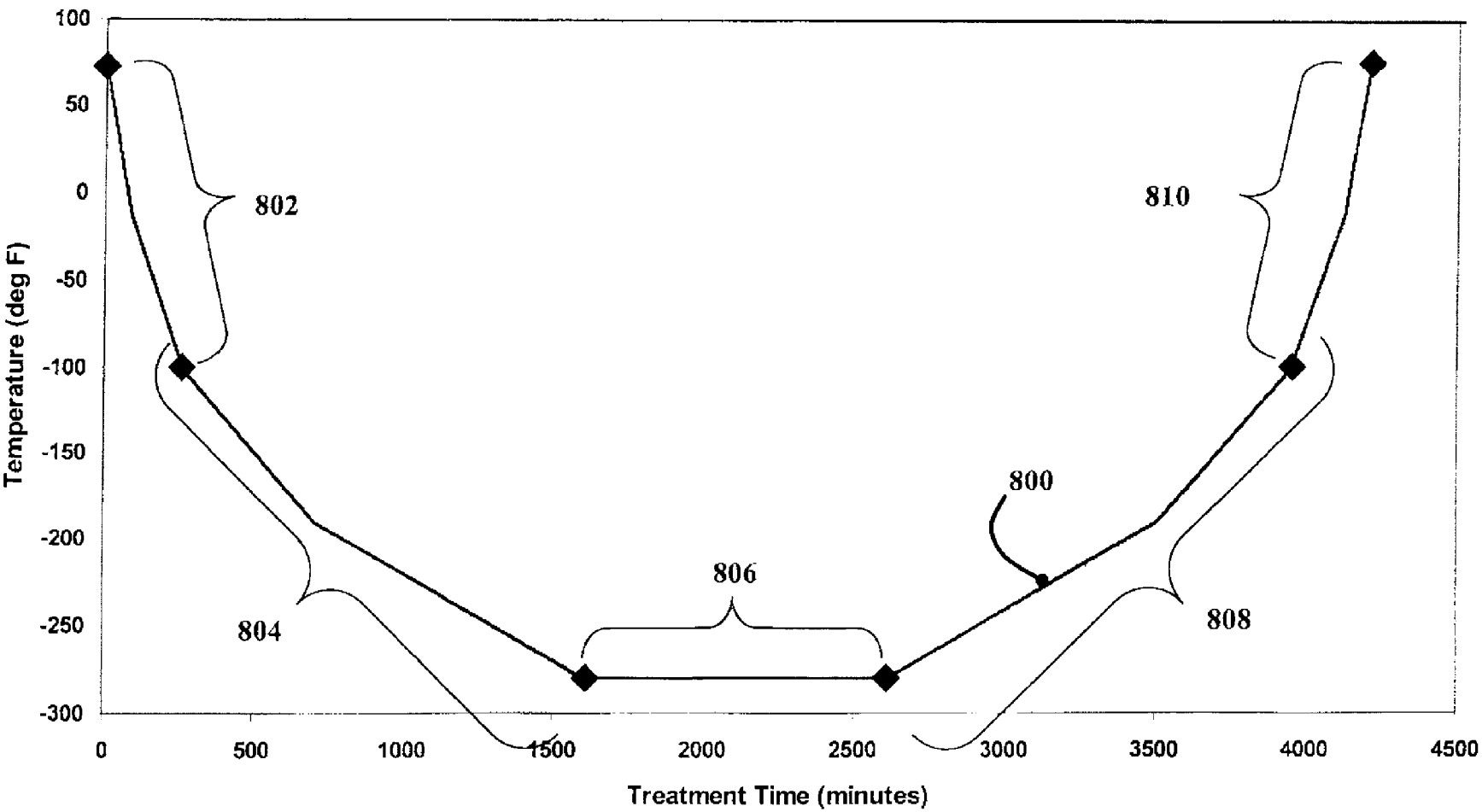
FIG. 8 is a detailed diagram of an embodiment of the invention, the Cycle 117.

FIG. 8 is a detailed diagram of another embodiment of the Cycle 117 800 according to an embodiment of the invention. As shown in FIG. 8, cycle 800 is comprised of an initial descent portion 802, a treatment descent portion 804, a treatment hold or soak portion 806, a treatment ascent portion 808, and a final ascent portion 810. The initial descent portion 802 or initial temperature descent for cryogenic treatment purposes can generally improve performance when the temperature is between about −80 degrees F. and about −100 degrees F. Temperature rates for an initial descent portion, such as 802, can range between about −0.5 degrees F. to about −10 degrees F. per minute, with about −0.5 degrees F. to about −1 degrees F. per minute in a certain embodiment of the invention. Note that temperature descents of about −10 degrees F. per minute or relatively faster may need excessive use of cryogenic coolant within a cryogenic treatment system, such as 100 in FIG. 1. Temperature rates for a treatment descent portion, such as 804, can be about 0.05 degrees F. to about −0.25 degrees F. per minute, with about −0.1 degrees F. to about −0.2 degrees F. per minute for a certain embodiment of the invention. Final temperature for a treatment descent portion, such as 804, can be about −275 degrees F. to −320 degrees F., with −280 degrees F. for a certain embodiment of the invention. Duration of a treatment hold or soak portion, such as 806, can be from about 0.1 hours to about 24 hours, with about 17 hours for a certain embodiment of the invention. A treatment hold or soak portion, such as 806, can also be omitted from the cycle 800 in certain embodiments. Temperature rates for a treatment ascent portion, such as 808, can be about 0.01 degrees F. to about +0.25 degrees F. per minute, with about +0.1 degrees F. to about +0.2 degrees F. per minute for a certain embodiment of the invention. Temperature rates for a final ascent portion, such as 810, can range between about +0.5 degrees F. to about +10 degrees F. per minute, with about +0.5 degrees F. to about +1 degrees F. per minute for a certain embodiment of the invention. Cycle 800 can be repeated multiple times with or without a treatment hold or soak portion, such as 806. Cryogenic treatment according to the cycle 800 shown in FIG. 8 can provide a process for cryogenically treating abrasive tools that utilize diamond materials wherein improved performance and service life can be achieved. In certain instances, the diamond particles associated with such tools and materials can be better-adhered or better-secured to the tool body and the strength and toughness of the diamond particles can be improved. Cryogenic treatment according to the cycle 800 shown in FIG. 8 can, in certain instances, reverse or undo the sintering-induced strength and fracture toughness degradations of the diamond particles.

Certain embodiments can also provide improved cutting performance for treated diamond core drills. For example, cutting performance of untreated diamond core drills have been compared to diamond core drills treated with Cycle 101, shown as 700 in FIG. 7, and other diamond core drills treated with Cycle 117, shown as 400 in FIG. 7. In one instance, more than ten drills of each type were tested. The untreated core drills cut an average of 35.2 holes before tool force for additional holes became excessive. Average time to cut the first 10 holes was about 8.08 seconds. The core drills treated with Cycle 101 700 cut an average of 48.4 holes before tool force became excessive. This is a life improvement of about 37.5% compared to the untreated core drills. Average time to cut the first 10 holes decreased to about 6.46 seconds, a speed improvement of about 25% compared to the untreated core drills. The core drills treated with Cycle 117 400 cut an average of 58.2 holes before tool force became excessive. This is a life improvement of about 65.3% compared to the untreated core drills, and an improvement of about 27.8% compared to the drills treated with Cycle 101 700. Average time to cut the first 10 holes decreased to 6.23 seconds, a speed improvement of about 29.8% compared to the untreated core drills and about a 5% improvement compared to the drills treated with Cycle 101 700. Based on the foregoing example, one may observe that certain embodiments of the invention can offer certain improvements over other treatment processes.

Certain embodiments of the invention can also provide improved cutting performance for diamond abrasive blades. In some instances, performance of such blades can be described using an "indexed score" comparison that provides a rating for cutting performance in relative terms of diamond blade wear and speed of cut. For example, the indexed scores for untreated approximately four-inch diameter continuous rim diamond abrasive blades have been compared to indexed scores for diamond abrasive blades treated with Cycle 117, such as 800 in FIG. 8. In one instance, at least four blades of each type were tested for cutting marble and porcelain. The untreated abrasive blades received an indexed score of about 1.00 based upon test results. The abrasive blades treated with Cycle 117 800 received an indexed score of about 1.12. In another instance, indexed scores were determined for approximately seven-inch diameter segmented rim diamond abrasive blades. Indexed scores were determined based upon testing of at least four untreated blades and at least four blades treated with Cycle 117 800. The untreated blades obtained an indexed score of about 0.96. The blades treated with Cycle 117 400 obtained an indexed score of about 1.08. Based on the foregoing example, one may observe that certain embodiments of the invention can offer certain improvements over other treatment processes.

Figure 9:
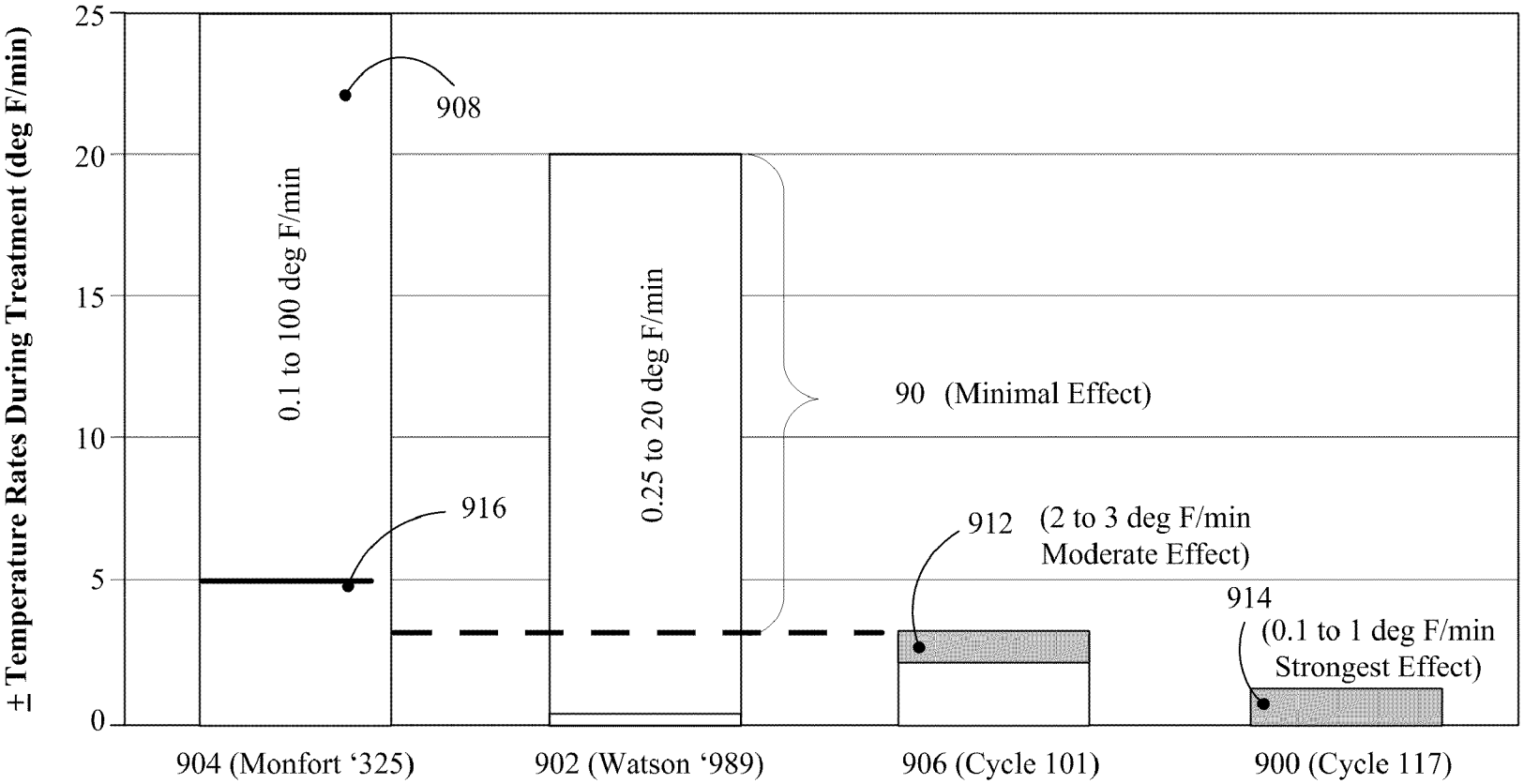
FIG. 9 is a first comparison of treatment rates used within an embodiment of the invention, the Cycle 117, the Watson '989 cycle, the Monfort '325 cycle, and the Cycle 101 in accordance with another embodiment of the invention.

FIG. 9 is a first comparison of treatment rates used within the Cycle 117 900 in accordance with an embodiment of the invention, the Watson '989 cycle 902, the Monfort '325 cycle 904, and the Cycle 101 906 in accordance with another embodiment of the invention. The Monfort '325 patent relates to temperature rates 908 that vary between about 0.1 degrees F. and about 100 degrees F. per minute. The Watson '989 application relates to rates that vary between about 0.25 degrees F. and about 20 degrees F. per minute, where FIG. 9 shows a region 910 of minimal effect that comprises temperature rates that vary between 3 and about 20 degrees F. per minute. FIG. 9 shows a region 912 of moderate effect associated with Cycle 101 906 that varies between about 2 degrees F. and about 3 degrees F. per minute, and a region 914 of strongest effect associated with Cycle 117 900 that varies between about 0.1 degrees F. and about 1 degrees F. per minute. Regions 910, 912 and 914 are defined based upon the results of treatments according to certain embodiments of the invention. Note that the treatment rate 916 of the Monfort '325 patent, or about 5 degrees F. per minute is in the region 910 of minimal effect similar to the Watson '989 application. Although not shown, the '079 patent to Waldmann relates to temperature rates that are about 0.5 degrees F. per minute and relatively more rapid rates.

Figure 10:
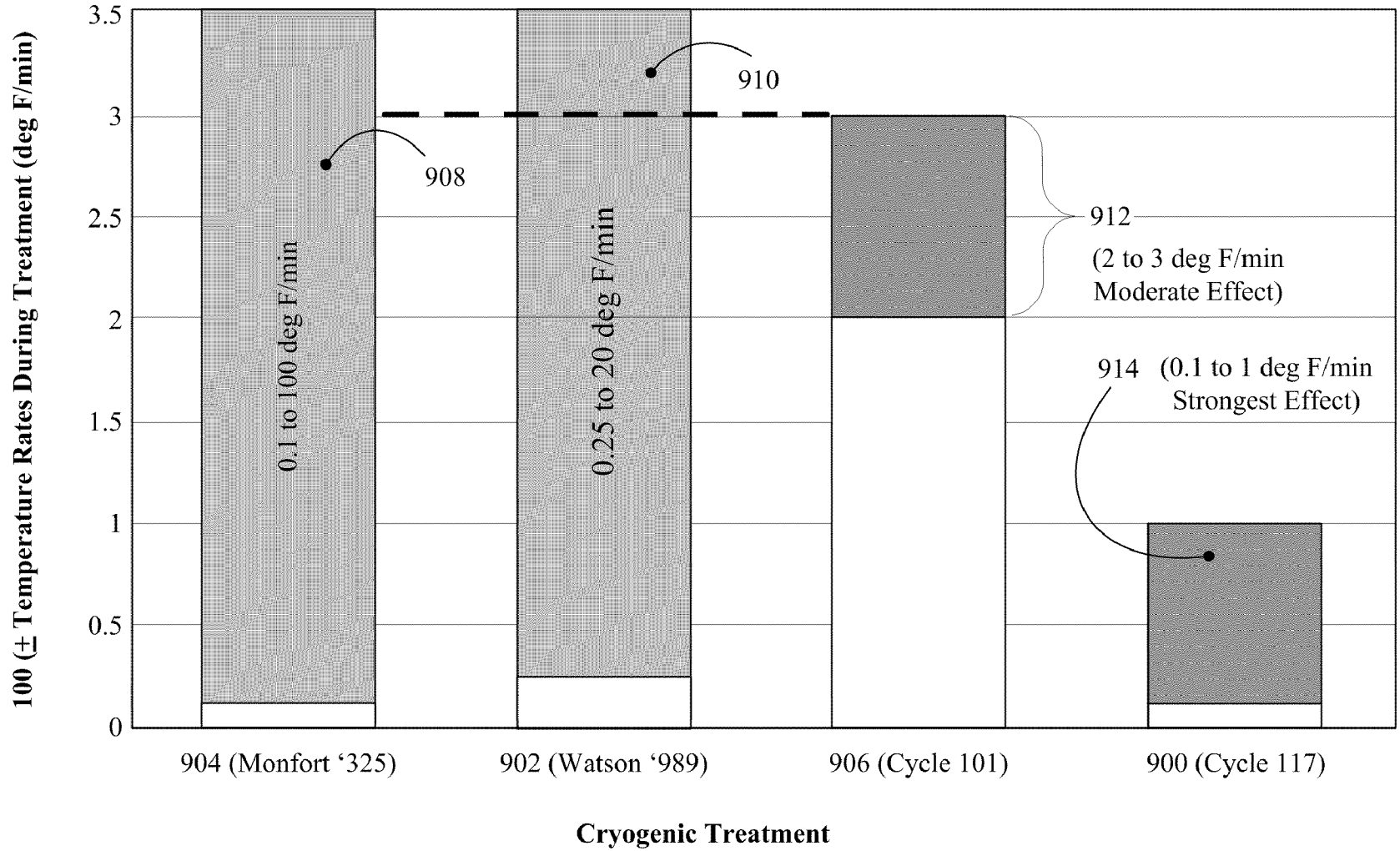
FIG. 10 is a second comparison of treatment rates used within an embodiment of the invention, the Cycle 117, the Watson '989 cycle, the Monfort '325 cycle, and the Cycle 101 in accordance with another embodiment of the invention.

FIG. 10 is a second comparison of treatment rates used within the Cycle 117 900 in accordance with an embodiment of the invention, the Watson '989 cycle 902, the Monfort '325 cycle 904, and the Cycle 101 906 in accordance with another embodiment of the invention. The vertical axis 1000 is shown in FIG. 10 is a relatively expanded view to show more detail for temperature rates between about 0 and about 3.5 degrees F. per minute. Note that the region 914 of relatively strongest effect has a portion between about 0.1 degrees F. per minute and about 0.25 degrees F. per minute that is outside the respective regions 908, 910 shown respectively by the Monfort '325 patent and Watson '989 application.

Figure 11:
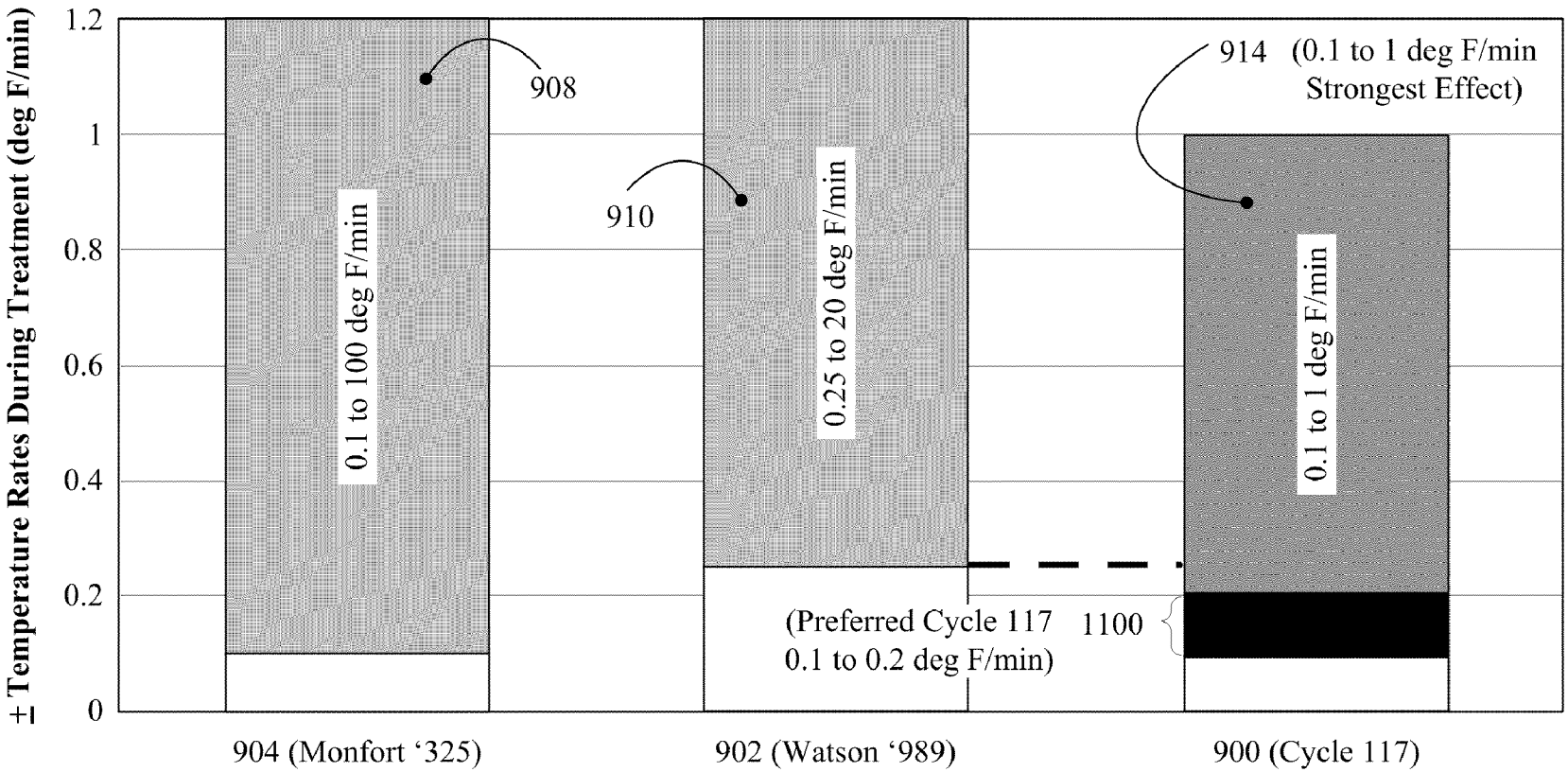
FIG. 11 is a comparison of treatment rates used within an embodiment of the invention, the Cycle 117, the Watson '989 cycle, and the Monfort '325 cycle also showing particular treatment rates according to an embodiment of the invention.

FIG. 11 is a further comparison of treatment rates used within the Cycle 117 900, the Watson '989 cycle 902, and the Monfort '325 cycle 904 also showing the treatment rates 1100 of an embodiment of the invention. Region 1100 falls at the lower end of the strongest effect region 914.

Figure 12:
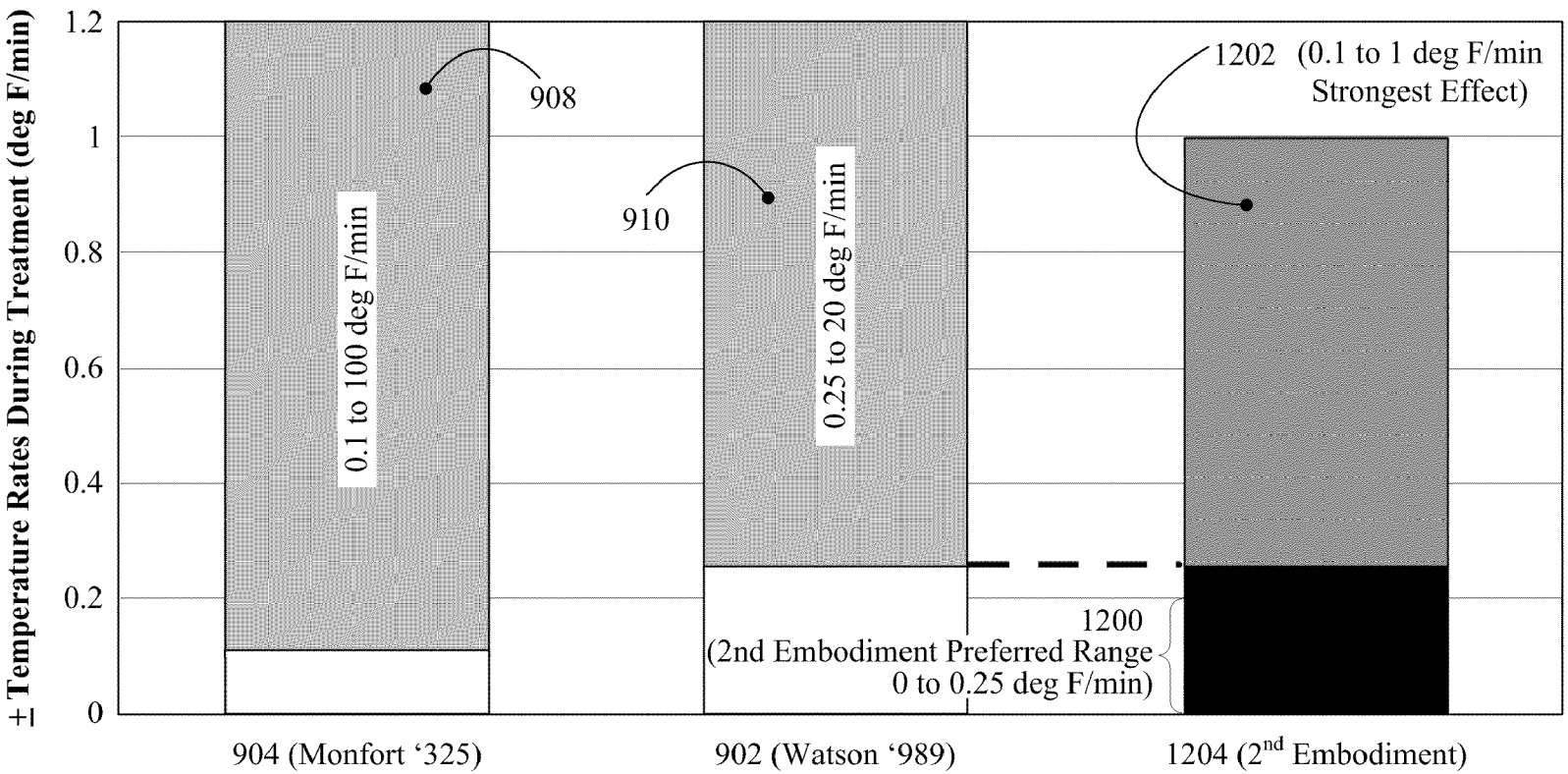
FIG. 12 is a comparison of treatment rates used within the Watson '989 cycle and the Monfort '325 cycle, and also showing particular treatment rates of an embodiment of the invention.

FIG. 12 is a comparison of treatment rates used within the Watson '989 cycle 902 and the Monfort '325 cycle 904 also showing the treatment rates 1200, 1202 of a second embodiment 1204 of the invention. Region 1200 falls at the lower end of the strongest effect region 1202, wherein region 1200 can be characterized by treatment rates at approximately 0.01 degrees F. per minute to approximately 0.25 degrees F. per minute, and the strongest effect region 1202 can be characterized by treatment rates at approximately 0.1 degrees F. per minute to approximately 1.0 degrees F. per minute.

Regions 1100, 1200, and 1202 of the embodiments of the invention shown in FIGS. 11 and 12 respectively are both outside the rates associated with the Watson '989 application, yet these regions 1100, 1200 can provide improved performance results for diamond materials including abrasive tooling. Although temperature rates as slow as about 0.1 degrees F. per minute are shown by the Monfort '325 patent, the Monfort '325 patent does not relate to the treatment of diamond materials nor does the reference contemplate that treatment rates less than about 0.25 degrees F. per minute can be effective for diamond-based materials. In this regard, certain embodiments of the invention provide improvements in cryogenic processing of certain materials.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

We claim:

1. A process to treat an abrasive tool using a cycling chamber, the process comprising:

(a) introducing an abrasive tool into a cycling chamber, wherein the tool has a temperature of about ambient temperature;

(b) introducing at least one cryogenic material into the cycling chamber, wherein the internal temperature of the cycling chamber or abrasive tool can be controlled by adjusting the flow rate of the at least one cryogenic material;

(c) decreasing the temperature of the cycling chamber or abrasive tool to a range from about −80 degrees Fahrenheit (F). to about −100 degrees F. at a rate of about −0.5 degrees F. per minute to about −10 degrees F. per minute;

(d) further decreasing the temperature of the cycling chamber or abrasive tool to a range from about −275 degrees F. to about −325 degrees F. at a rate of about −0.05 degrees F. per minute to about −0.20 degrees F. per minute;

(e) increasing the temperature of the cycling chamber or abrasive tool to a range from about −80 degrees F. to about −100 degrees F. at a rate of about 0.05 degrees F. per minute to about 0.20 degrees F. per minute; and (f) further increasing the temperature of the cycling chamber or abrasive tool to about ambient temperature at a rate of about 0.5 degrees F. to about 10 degrees F., and resulting in a strengthened and toughened abrasive tool.

2. The process of claim 1, further comprising (d1) maintaining the temperature of the cycling chamber or abrasive tool in a range from about −275 degrees F. to about −325 degrees F. for about 0.1 hours to about 24 hours.

3. The process of claim 1, further comprising (d1) maintaining the temperature of the cycling chamber or abrasive tool in a range from about −275 degrees F. to about −325 degrees F. for about 17 hours.

4. The process of claim 2, wherein elements (c), (d), (d1), (e), and (f) are repeated at least once.

5. The process of claim 1, wherein introducing an abrasive tool into a cycling chamber, comprises introducing an abrasive tool comprising at least one diamond-based material.

6. The process of claim 1, wherein further decreasing the temperature of the cycling chamber or abrasive tool to a range from about −275 degrees F. to about −325 degrees F. comprises a rate of about −0.10 degrees F. per minute to about −0.20 degrees F. per minute.

7. The process of claim 1, wherein increasing the temperature of the cycling chamber or abrasive tool to a range from about −80 degrees F. to about −100 degrees F. comprises a rate of about 0.10 degrees per minute to about 0.20 degrees F. per minute.

8. The process of claim 1, wherein elements (c) through (f) are repeated.

9. The process of claim 1, further comprising:

(b1) decreasing the temperature of the cycling chamber or abrasive tool from ambient temperature to about −10 degrees Fahrenheit (F). at a rate of about −1.0 degrees F. per minute;

(c1) further decreasing the temperature of the cycling chamber or abrasive tool to about −190 degrees F. at a rate of about −0.2 degrees F. per minute;

(d1) maintaining the temperature of the cycling chamber or abrasive tool at about −280 degrees F. for about 17 hours;

(d2) increasing the temperature of the cycling chamber or abrasive tool to about −190 degrees F. at a rate of about 0.1 degrees F. per minute; and (e1) further increasing the temperature of the cycling chamber or abrasive tool to about −10 degrees F. at a rate of about 0.5 degrees F. per minute.

10. A process for forming an abrasive tool having at least one diamond-based material, the process comprising:

(a) introducing the abrasive tool into a cycling chamber, wherein the tool has a temperature of about ambient temperature;

(b) introducing at least one cryogenic material into the cycling chamber, wherein the internal temperature of the chamber or abrasive tool can be controlled by adjusting the flow rate of the at least one cryogenic material;

(c) decreasing the temperature of the cycling chamber or abrasive tool from ambient temperature to a range from about −80 degrees Fahrenheit (F). to about −100 degrees F. at a rate of about −0.5 degrees F. per minute to about −10 degrees F. per minute;

(d) further decreasing the temperature of the cycling chamber or abrasive tool to a range from about −275 degrees F. to about −325 degrees F. at a rate of about −0.05 degrees F. per minute to about −0.20 degrees F. per minute;

(e) increasing the temperature of the cycling chamber or abrasive tool to a range from about −80 degrees F. to about −100 degrees F. at a rate of about 0.05 degrees F. per minute to about 0.20 degrees F. per minute; and (f) further increasing the temperature of the cycling chamber or abrasive tool to about ambient temperature at a rate of about 0.5 degrees F. per minute to about 10 degrees F. per minute.

11. The process of claim 10, wherein the process further comprises (d1) maintaining the temperature of the cycling chamber or abrasive tool in a range from about −275 degrees F. to about −325 degrees F. for about 0.1 hours to about 24 hours.

12. The process of claim 10, wherein the process further comprises (d1) maintaining the temperature of the cycling chamber or abrasive tool in a range from about −275 degrees F. to about −325 degrees F. for about 17 hours.

13. The process of claim 11, wherein elements (c), (d), (d1), (e), and (f) are repeated at least once.

14. The process of claim 10, wherein introducing an abrasive tool into a cycling chamber, comprises introducing an abrasive tool comprising at least one diamond-based material.

15. The process of claim 10, wherein further decreasing the temperature of the cycling chamber or abrasive tool to a range from about −275 degrees F. to about −325 degrees F. comprises a rate of about −0.10 degrees F. per minute to about −0.20 degrees F. per minute.

16. The process of claim 10, wherein increasing the temperature of the cycling chamber or abrasive tool to a range from about −80 degrees F. to about −100 degrees F. comprises a rate of about 0.10 degrees F. per minute to about 0.20 degrees F. per minute.

17. The process of claim 10, wherein elements (c) through (f) are repeated.

18. The process of claim 10, further comprising:

(b1) decreasing the temperature of the cycling chamber or abrasive tool from ambient temperature to about −10 degrees Fahrenheit (F). at a rate of about −1.0 degrees F. per minute;

(c1) further decreasing the temperature of the cycling chamber or abrasive tool to about −190 degrees F. at a rate of about −0.2 degrees F. per minute;

(d1) maintaining the temperature of the cycling chamber or abrasive tool at about −280 degrees F. for about 17 hours;

(d2) increasing the temperature of the cycling chamber or abrasive tool to about −190 degrees F. at a rate of about 0.1 degrees F. per minute; and (e1) further increasing the temperature of the cycling chamber or abrasive tool to about −10 degrees F. at a rate of about 0.5 degrees F. per minute.

19. A process to treat an abrasive tool using at least one cryogenic material in a cycling chamber, the process comprising:

decreasing the temperature of the cycling chamber or abrasive tool from ambient temperature to a range from about −80 degrees Fahrenheit (F) to about −100 degrees F. at a rate of about −0.5 degrees F. per minute to about −10 degrees F. per minute;

further decreasing the temperature of the cycling chamber or abrasive tool to a range from about −275 degrees F. to about −325 degrees F. at a rate of about −0.05 degrees F. per minute to about −0.20 degrees F. per minute;

increasing the temperature of the cycling chamber or abrasive tool to a range from about −80 degrees F. to about −100 degrees F. at a rate of about 0.05 degrees F. per minute to about 0.20 degrees F. per minute; and further increasing the temperature of the cycling chamber or abrasive tool to about ambient temperature at a rate of about 0.5 degrees F. per minute to about 10 degrees F. per minute, and resulting in a strengthened and toughened abrasive tool.

20. The process of claim 19, further comprising maintaining the temperature of the cycling chamber or abrasive tool in a range from at about −275 degrees F. to about −325 degrees F. for about 0.1 hours to about 24 hours.

* * * * *